United States Patent [19]

Moser et al.

[11] 3,965,331

[45] June 22, 1976

[54] DUAL MODE ROLL FUSER

[75] Inventors: Rabin Moser, Fairport; Ernest A. Weiler, Rochester, both of N.Y.

[73] Assignee: Xerox Corporation, Stamford, Conn.

[22] Filed: Feb. 24, 1975

[21] Appl. No.: 552,477

[52] U.S. Cl. ..... 219/216; 219/388; 219/469; 219/470; 432/60; 432/228

[51] Int. Cl.[2] ..... H05B 1/00

[58] Field of Search ..... 219/216, 388, 469–471; 432/59, 60, 228, 227; 250/317–319; 355/3 R

[56] References Cited

UNITED STATES PATENTS

| | | | |
|---|---|---|---|
| 3,291,466 | 12/1966 | Aser et al. | 219/388 X |
| 3,359,404 | 12/1967 | Limberger | 219/216 |
| 3,452,181 | 6/1969 | Stryjewski | 219/388 X |
| 3,809,854 | 5/1974 | Sandeis | 219/216 |
| 3,810,776 | 5/1974 | Banks et al. | 219/216 X |

*Primary Examiner*—C. L. Albritton

[57] ABSTRACT

A contact fuser assembly for use in an electrostatic reproducing apparatus wherein toner images are formed on various types of substrates, for example, plain paper and transparency materials such as cellulose acetate or polyester film. The fuser assembly is characterized by a provision of a plurality of fuser rolls forming a pair of nips through which the substrates pass in order to fuse the toner images thereto. Transport mechanism is provided for conveying the substrates to one or the other of the nips depending upon the particular material of the substrate. The surface of the roll provided for contacting the plain paper comprises a hard metal surface and the roll for contacting the toner images carried by the cellulose acetate, etc. comprises an elastomeric surface.

9 Claims, 3 Drawing Figures

DUAL MODE ROLL FUSER

BACKGROUND OF THE INVENTION

This invention relates generally to xerographic copying apparatus and, more particularly, to a contact fusing system for fixing electroscopic toner material to a support member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member or transferred from the member to a sheet of plain paper with subsequent affixing of the image thereto.

In order to permanently affix or fuse electroscopic toner material onto a support member by heat, it is necessary to elevate the temperature of the toner material to a point at which the constituents of the toner material coalesce and become tacky. This action causes the toner to be absorbed to some extent into the fibers of the support member which, in many instances, constitutes plain paper and in other instances constitutes cellulose acetate or polyester film. Thereafter, as the toner material cools, solidification of the toner material occurs causing the toner material to be firmly bonded to the support member. In both the xerographic as well as the electrographic recording arts, the use of thermal energy for fixing toner images onto a support member is old and well known.

One approach to thermal fusing of electroscopic toner images onto a support has been to pass the support with toner images thereon between a pair of opposed roller members, at least one of which is internally heated. During operation of a fusing system of this type, the support member to which the toner images are electrostatically adhered is moved through the nip formed between the rolls with the toner image contacting the fuser roll to thereby effect heating of the toner images within the nip.

Heretofore, the surface of the fuser roll structure of contact fuser assemblies have been fabricated from one of various materials, for example, Teflon, silicone rubber, and certain metals such as copper. Experience with such materials has shown that certain difficulties arise when a particular substrate is employed with a particular surface material. For example, when transparencies which utilize polyester film-type material have toner images fused thereto by a metal surface roll the transparency exhibits halos around thick lined images because the substrate is not flexible enough to conform to the sudden change in toner pile height. Moreover, it is difficult to strip high pile, continuous tone images from the hard fuser roll as the plasticized toner flows into the fuser roll surface. This confirmation of the toner image to the fuser roll not only results in stripping difficulties but also imparts a finish to the toner surface which corresponds to the surface of the fuser roll. Thus, if the roll is smooth a high gloss image is obtained.

On the other hand, when a fuser roll surface comprises an elastic material such as silicone rubber or Viton the fused image exhibits a matte finish on plain paper which does not appeal to most people utilizing xerographic apparatus.

Accordingly, the primary object of this invention is to provide a new and improved apparatus for fusing toner images.

It is a more particular object of this invention to provide a new and improved fuser apparatus for fixing toner images to various substrates.

Another object of this invention is to provide a fuser apparatus comprising a plurality of fuser roll structures forming a pair of nips through which substrates are moved in order to fuse the images and wherein the substrates of one type are passed through one of the nips while substrates of another type are passed through the other of the nips whereby the substrate and toner images carried thereby contact different surfaces depending upon the substrate.

BRIEF SUMMARY OF THE INVENTION

Briefly, the above-cited objects are accomplished by the provision of a contact fuser apparatus including in one embodiment thereof a pair of metal-surfaced rolls cooperating with an elastomeric-surfaced roll to form two nip areas through which substrates are passed in order to fuse the toner images to the substrate. The orientation of the substrates is such that the toner images are always on the upper surface thereof. Accordingly, the aforementioned roll structures are so arranged so that when the substrate passes through one of the nips the toner images contact the metalsurfaced roll and when the substrates are passed through the other nip the toner images are contacted by the elastomeric surfaced roll. A conveyor belt transport at the inlet of the fuser is shiftable between different positions in order to feed the substrates to the different nips depending upon the particular type of material of the substrate.

In another embodiment of the invention, a pair of elastomeric surface rolls cooperate with a metal-surfaced roll to form the two nips. As in the case of the first embodiment described above, the transport mechanism is shiftable between positions adapted to feed the substrates to one nip or the other in accordance with the particular composition of the substrate.

Other objects and advantages of the present invention will become apparent when read in conjunction with the accompanying drawings.

DETAILED DESCRIPTION OF THE DRAWINGS

DETAILED DESCRIPTION OF THE PREFERRED EMBODIMENT

Figure 1:
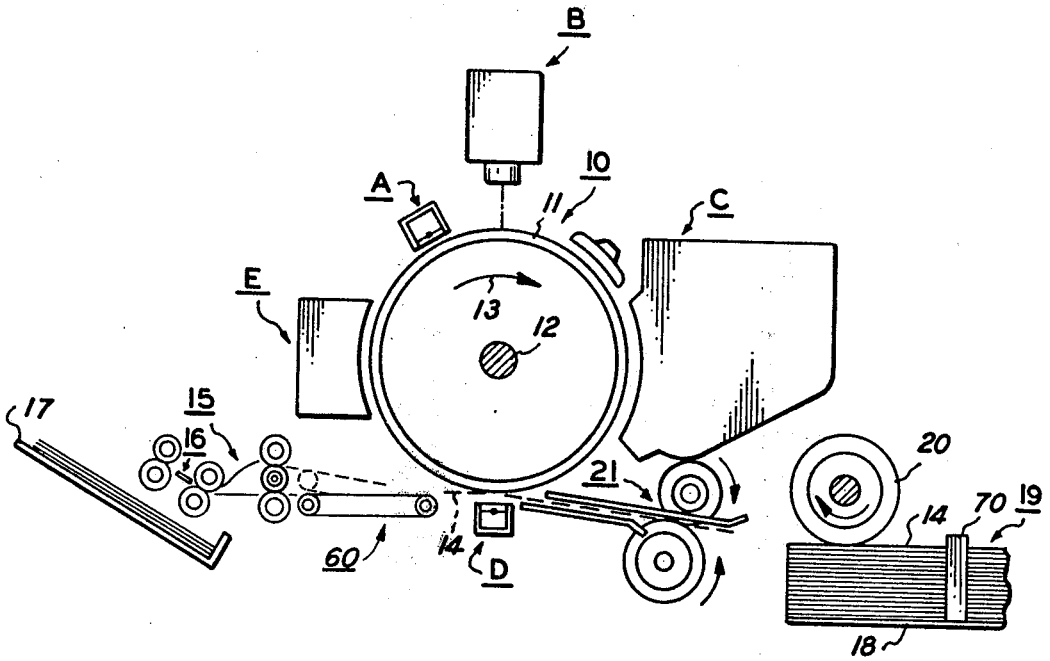
FIG. 1 is a schematic representation of a xerographic reproducing apparatus incorporating the novel contact fuser of this invention.

The reproducing machine illustrated in FIG. 1 employs an image recording drum-like member 10 the outer periphery of which is coated with a suitable photoconductive material 11. One type of photoconductive material is disclosed in U.S. Pat. No. 2,970,906 issued to Bixby in 1961. The drum 10 is suitably journaled for rotation within a machine frame (not shown) by means of a shaft 12 and rotates in the direction indicated by arrow 13, to bring the image retaining surface thereon past a plurality of xerographic processing stations. Suitable drive means (not shown) are provided to power and coordinate the motion of the various cooperating machine components whereby a faithful reproduction of the original input scene information is recorded upon a sheet of final support material such as paper or the like.

Since the practice of xerography is well known in the art, the various processing stations for producing a copy of an original are herein represented in FIG. 1 as blocks A to E. Initially, the drum moves photoconductive surface 11 through charging station A. At charging station A an electrostatic charge is placed uniformly over the photoconductive surface 11 of the drum 10 preparatory to imaging. The charging may be provided by a corona generating device of a type described in U.S. Pat. No. 2,836,725 issued to Vyverberg in 1958.

Thereafter, the drum 10 is rotated to exposure station B where the charged photoconductive surface 11 is exposed to a light image of the original input scene information, whereby the charge is selectively dissipated in the light exposed regions to record the original input scene in the form of a latent electrostatic image. A suitable exposure system may be of the type described in U.S. patent application Ser. No. 259,181, filed June 2, 1972.

After exposure, drum 10 rotates the electrostatic latent image recorded on the photoconductive surface 11 to development station C, wherein a conventional developer mix is applied to the photoconductive surface 11 of the drum 10 rendering the latent image visible. A suitable development station is disclosed in U.S. patent application Ser. No. 199,481, filed Nov. 17, 1971. This application describes a magnetic brush development system utilizing a magnetizable developer mix having carrier granules and toner comprising electrophotographic resin plus colorant from dyes or pigments. A developer mix is continually brought through a direction flux field to form a brush thereof. The electrostatic latent image recorded on photoconductive surface 11 is developed by bringing the brush of developer mix into contact therewith. The developed image on the photoconductive surface 11 is then brought into contact with a sheet of final support material 14 within a transfer station D and the toner image is transferred from the photoconductive surface 11 to the contacting side of the final support sheet 14. The final support material may be plain paper, gummed labels, transparencies, such as polycarbonate, polysulfane and Mylar, etc., as desired.

After the toner image has been transferred to the sheet of final support material 14, the sheet with the image thereon is advanced to a suitable fuser assembly 15 which fuses the transfer powder image thereto. After the fusing process, the final support material 14 is advanced by a series of rolls 16 to a copy paper tray 17 for subsequent removal therefrom by a machine operator.

Although a preponderence of the toner powder is transferred to the final support material 14, invariably some residual toner remains on the photoconductive surface 11 after the transfer of the toner powder image to the final support material 14. The residual toner particles remaining on the photoconductive surface 11 after the transfer operation are removed from the drum 10 as it moves through cleaning station E. Here the residual toner particles are first brought under the influence of a cleaning corona generating device (not shown) adapted to neutralize the electrostatic charge remaining on the toner particles. The neutralized toner particles are then mechanically cleaned from the photoconductive surface 11 by conventional means as for example, the use of a resiliently biased knife blade as set forth in U.S. Pat. No. 3,660,863 issued to Gerbasi in 1972.

The sheets of final support material 14 processed in the automatic xerographic reproducing device may be stored in the machine within a removable paper cassette 18. A suitable paper cassette is set forth in U.S. pat. application Ser. No. 208,138 filed Dec. 15, 1971.

The copier can also have the capability of accepting and processing copy sheets of varying lengths. The length of the copy sheet, of course, being dictated by the size of the original input scene information recorded on the photoconductive surface 11. To this end, the paper cassette 18 is preferably provided with an adjustable feature whereby sheets of varying length and width can be conveniently accommodated therein.

In operation, the cassette 18 is filled with the stack of final support material 19 of pre-selected size and the cassette 18 is inserted into the machine by sliding along a baseplate (not shown) which guides the cassette 18 into operable relationship with a pair of feed rollers 20. When properly positioned in communication with the feed rollers 20 the top sheet of the stack 19 is separated and forwarded from the stack 19 into the transfer station D by means of registration rollers 21.

It is believed that the foregoing description is sufficient for purposes of present application to illustrate the general operation of an automatic xerographic copier which can embody the teachings of the present invention.

The fuser assembly 15 comprises a heated roll structure 30 including a hollow cylinder or core 31 having a suitable heating element 32 disposed therein and coextensive therewith. The heating element 32 may comprise any suitable type heater for elevating the surface temperature of the cylinder to operational temperatures, therefore, 250°–400°F. For example, it may be a quartz lamp. The cylinder 31 is fabricated from any suitable material capable of accomplishing the objects of the present invention. Typical materials are copper, anodized aluminum and alloys thereof, steel, stainless steel, nickel and alloys thereof, nickel plated copper, chrome plated copper, and glass. The resulting structure has an outside diameter on the order of 1.5–3 inches and has a length on the order of 10–15 inches. Power requirements for the foregoing are 500–2500 watts peak power with an average power 300–2000 watts and 75–250 watts for standby.

The surface temperature of the fuser roll structure is controlled by contacting the surface thereof with a thermistor probe 45 as described in U.S. Pat. No. 3,327,096 issued in 1967 to Bernous and incorporated herein by reference.

The fuser assembly 15 further comprises a roll structure 33 which cooperates with the fuser roll structure 30 to form a nip 34 through which a plain paper substrate 35 passes, such that toner images 36 thereon contact the fuser roll structure. The roll structure 33 may comprise any suitable construction, for example, a steel cylinder, but preferably comprises a rigid steel core 37 having a Viton elastomer surface or layer 38 thereon. A suitable roll structure 33 has a core approximately 1.8 inches in diameter with a 0.1 inch cover or layer structure of Viton elastomer or other suitable high temperature elastomeric structure, for example, silicone rubber or a combination of Viton or silicone rubber with Teflon. Viton is the trademark of duPont Company. The specific dimensions of the members making up the roll structure 33 will be dictated by the requirements of the particular copying apparatus wherein the fuser assembly 15 is employed, the dimensions being greater or less depending upon the process speed of the machine. The heated roll structure 30 and the roll structure 33 may be mounted on fixed axes or they may be mounted such that the fuser roll structure roll 30 is moved into and out of engagement with the roll structure 33. In either arrangement, means (not shown) for applying a loading force to the fuser assembly 15 serves to create nip pressures on the order of 15 to 150 psi average. The durometer of the roll structure 33 is chosen such that "dwell time" of 5 to 100 milliseconds can be obtained with loading forces within the aforementioned range of pressures. Dwell time is proportional to the ratio of the nip length to the surface speed of the rolls. For a given angular velocity the surface speeds will vary depending upon the diameter of the roll. For example, with a two inch fuser roll speed of 0 to 30 inches per second are obtainable and for a 3 inch roll, fuser roll speeds of 0 to 45 inches per second have been attained. Accordingly, it can be seen that the aforementioned dwell time can be obtained on varying one or the other or both of the dwell time relationships. Durometers of 20–90 Shore A have been found to provide satisfactory results.

A third roll structure 40 comprises a hollow cylinder or core 42 having a suitable heating element 44 disposed therein and coextensive therewith. The heating element 44 may be similar to the heating element 32 and the cylinder or core 42 may be similar to the core 31 of the roll structure 30. The roll structure 40 forms a nip 46 with the roll structure 33 through which a transparency substrate 48 of polyester or cellulose acetate material passes such that the toner images 50 carried thereby contact the roll structure 33. A preheat lamp 52 and associated reflector 54 are provided to insure that the surface of the roll 33 is at the proper temperature for fusing the toner images carried by the substrate 48.

In order to prevent offsetting of toner material to the fuser roll structures a release agent material 56 is provided in a sump 58 such that the release agent material can be applied to the surface of the roll structure 30 and through contact of the roll 30 with the roll 33 conveying the release agent material thereto. It will be appreciated that the foregoing arrangement would be satisfactory only where the rolls are permanently nipped. Where the rolls are moved into and out of engagement to form the nip, the roll 33 would have to have a separate supply of release agent material. A release agent material that has been found suitable for a fuser of the type herein described comprises low molecular weight polyethylene hopolymer manufactured by Allied Chemical Co. and having the designation AC-8 hopolymer.

Figure 2:
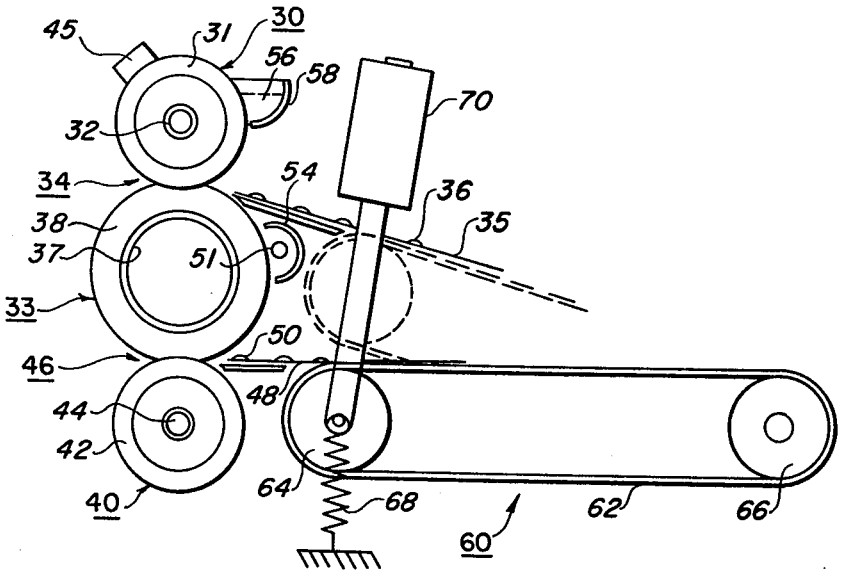
FIG. 2 is a side elevational view of a fuser system incorporated in the apparatus of FIG. 1.

A hinged transport mechanism generally indicated at 60 comprises a belt 62 entrained about rollers 64 and 66 one of which is adapted in a conventional manner to be power driven in order to move the belt and the substrates conveyed thereby. The belt and roller 64 are adapted to be pivoted about the roller 66 from the position shown in solid-line in FIGS. 2 and 3 to the position shown in dotted-line and returned to the solid-line position in order to direct the substrate to one or the other of the nips 34 and 46. The belt and roll configuration or transport mechanism is normally biased by means of a spring 68 into the solid-line position and is moved to the dotted-line position by means of a solenoid 70. The desired positioning can be accomplished by an operator pressing a button on the control panel of the reproducing apparatus.

Figure 3:
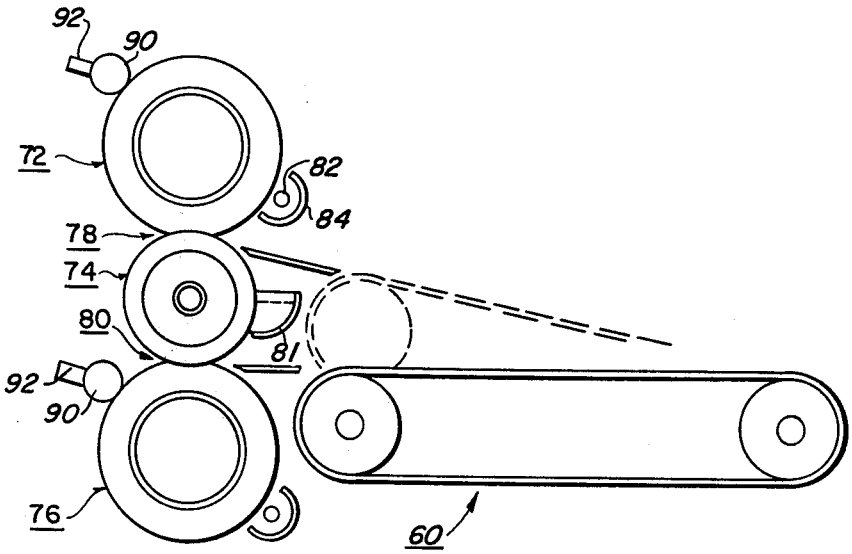
FIG. 3 is a side elevational view of a modified form of the fuser apparatus disclosed in FIG. 1.

The embodiment disclosed in FIG. 3 of the drawings comprises a plurality of fuser roll structures 72, 74 and 76 forming a pair of nips 78 and 80 as shown. A preheat lamp 82 and associated reflector 84 serve to insure the elevation of the roll structure 72 to a suitable fusing temperature. The roll structures 72 and 76 are identical in construction to the fuser roll structure 33 while the fuser roll structure 74 is equivalent of the fuser roll structures 30 and 40 of FIG. 1. A sump 81 containing a quantity of polyethylene release agent material is provided for metering release agents to the fuser roll structure 74.

A release agent dispensing member in the form of a heated roll 90 contacts the roll 72 in order to apply release agent material from a bar 92 thereof which contacts the roll and is applied thereto by melting of the bar.

In the embodiment of FIG. 3 the fuser roll structure is driven in both the clockwise and counterclockwise directions and through its frictional contact with the rolls 72 and 76 drives those rolls in the appropriate direction. The specific drive would be obvious to those skilled in the art and therefore has been omitted for sake of clarity. The fuser roll structures 30 and 40 each have a one way drive system whereby the roll 30 rotates in a clockwise direction and thereby rotates the roll 33 in a counterclockwise direction while the roll 40 is positively driven in a counterclockwise direction and through its frictional engagement with the roll 33 drives that roll in a clockwise direction.

While the invention has been described with respect to preferred embodiment it will be apparent that certain modifications and changes can be made without departing from the spirit and scope of the invention, for example, the three-roll arrangement could be replaced by a two-roll arrangement, one roll comprising a surface of metal and the other roll comprising a surface of elastomeric material wherein mechanism is provided for interchanging the positions of the rolls depending upon the particular substrate to which images are to be fused. In such an arrangement the belt transport mechanism need not be shifted from position to position for effecting movement of the substrate into contact with different rolls surfaces. Furthermore, any substrate can have toner images fused thereto by either roll surface depending upon the choice of the operator. Accordingly, it is intended that the foregoing disclosure be limited only by the claims appended hereto.

What is claimed is:

1. Dual mode fuser apparatus for fixing toner images to various types of substrates, said apparatus comprising:

fuser structure comprising first and second fuser members;

transport structure for conveying said substrates such that the toner images carried thereby contact one of said members during a first mode of operation; and means for effecting reorientation of one of said structures to move said substrates such that the toner images carried thereby contact the other of said fuser members during a second mode of operation.

2. Apparatus according to claim 1, wherein said first and second fuser members form a first nip therebetween and wherein a third member forms a second nip with said second fuser member and said reorientation effecting means comprises means for moving said transport structure such that it cooperates with one or the other of said nips depending on the mode of operation of said fuser apparatus.

3. Apparatus according to claim 2, wherein said fuser members comprise roll structures.

4. Apparatus according to claim 3, wherein said first and third members comprise metal surfaces and said second member comprises an elastomeric surface.

5. Apparatus according to claim 2, wherein said first and third members comprise elastomeric surfaces and said second member comprises a metal surface.

6. Apparatus according to claim 4, including means for applying release agent material to said first and second members.

7. Dual mode fuser apparatus for fixing toner images to substrates, said apparatus comprising:

a plurality of fuser members forming a plurality of nips through which said substrates pass with said toner images contacting the surface of at least two of said fuser members, said two surfaces being fabricated from different materials; and transport means for conveying said substrates to one of said nips during a first mode of operation and to another of said nips during a second mode of operation, said transport means comprising a belt structure shiftable to different positions for conveying said substrates to said nips.

8. Apparatus according to claim 7, wherein the surface of one of said fuser members comprises metal and the surface of the other fuser member comprises an elastomeric material.

9. Apparatus according to claim 7, including means for applying release agent material to said fuser members.

* * * * *